US006898393B2

(12) United States Patent
Kawamura

(10) Patent No.: US 6,898,393 B2
(45) Date of Patent: May 24, 2005

(54) IMAGE FORMING APPARATUS WITH TRANSFER MEMBER AND CHARGING MEMBER CLEANING FEATURE

(75) Inventor: Takeshi Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/411,323

(22) Filed: Apr. 11, 2003

(65) Prior Publication Data

US 2003/0194249 A1 Oct. 16, 2003

(30) Foreign Application Priority Data

Apr. 15, 2002 (JP) ..... 2002-111946

(51) Int. Cl.[7] ..... G03G 15/02; G03G 15/16

(52) U.S. Cl. ..... 399/100; 399/101

(58) Field of Search ..... 399/50, 66, 98, 399/99, 100, 101, 149, 150, 168, 174, 175, 176, 297, 310, 313, 314, 343

(56) References Cited

U.S. PATENT DOCUMENTS 5,182,604 A * 1/1993 Asai ..... 399/168
5,541,717 A * 7/1996 Saito et al. ..... 399/150
5,966,563 A * 10/1999 Kashihara et al. ..... 399/100
5,970,279 A * 10/1999 Sakaizawa et al. ..... 399/149 X
5,999,773 A * 12/1999 Yasutomi et al. ..... 399/100 X
6,081,679 A * 6/2000 Yamane et al. ..... 399/100 X
6,128,456 A 10/2000 Chigono et al. ..... 399/176
6,173,135 B1 * 1/2001 Yuminamochi et al. ..... 399/66
6,226,480 B1 * 5/2001 Hirabayashi et al. ... 399/149 X
6,438,331 B2 * 8/2002 Sakaizawa et al. ..... 399/50

FOREIGN PATENT DOCUMENTS

| | | | |
|---|---|---|---|
| JP | 10-307455 | | 11/1998 |
| JP | 10-307456 | | 11/1998 |
| JP | 11-65231 | | 3/1999 |
| JP | 2001-188405 | * | 7/2001 |
| JP | 2001-188454 | * | 7/2001 |

* cited by examiner

*Primary Examiner*—Sandra L. Brase
(74) *Attorney, Agent, or Firm*—Fitzpatrick, Cella, Harper & Scinto

(57) ABSTRACT

The image forming apparatus includes a movable image bearing member, a charging member opposed to the image bearing member in a charging portion, a transfer member for transferring an image formed on the image bearing member to a transferred member, and a cleaning mode for applying a voltage to the transfer member, and when other area on the image bearing member differing from a surface potential changing area on the image bearing member which is changed in surface potential by the application of this voltage is located in the charging portion, applying a voltage to the charging member, thereby cleaning the transfer member and the charging member. Thereby, the cleaning of the charging member can be effected well.

16 Claims, 10 Drawing Sheets

[−] : TONER IN CHARGING MEMBER

⊖ : TONER IN TRANSFERRING MEMBER

IMAGE FORMING APPARATUS WITH TRANSFER MEMBER AND CHARGING MEMBER CLEANING FEATURE

BACKGROUND OF THE INVENTION

1. Field of the Invention

This invention relates to an image forming apparatus such as an electrophotographic copying machine or an electrophotographic printer, and more particularly to a cleanerless image forming apparatus.

2. Description of Related Art

FIG. 12 of the accompanying drawings schematically shows the construction of an example of a cleanerless electrophotographic image forming apparatus as an example of the prior art.

The reference numeral 1 designates an electrophotographic photosensitive member as an image bearing member which is usually made into a drum shape (hereinafter referred to as the photosensitive drum) and is rotatively driven at a predetermined peripheral speed in the direction of arrow. This photosensitive drum 1 is uniformly charged by a primary charging device 3.

In the present example, the primary charging device 3 is a contact charging device using a charging roller (electrically conductive roller) as a contact charging member. The reference character a denotes a charging nip part. A predetermined superimposed voltage comprising a DC voltage and an AC voltage is applied from a voltage source (power supply) 6 to the charging roller 3, whereby the peripheral surface of the photosensitive drum 1 is uniformly charged to a predetermined polarity and potential.

Next, the application of light is effected from a exposure apparatus 4 onto the photosensitive drum 1 at an exposure position b correspondingly to image information inputted from an external apparatus to thereby form an electrostatic latent image.

This electrostatic latent image on the photosensitive drum 1 is visualized as a toner image in the developing region C of a developing apparatus 2 by a toner T having the same triboelectrification polarity as the applied voltage to the primary charging device 3.

In the present example, the developing apparatus 2 is a magnetic single-component developing apparatus. This developing apparatus 2 feeds the toner T in a toner container by a toner feeding member 23, rotates a developer bearing member (hereinafter referred to as a developing roller) 21 containing a stationary magnet therein and also forms a toner layer given triboelectrification charges on the surface of the developing roller 21 by a developer regulating member (hereinafter referred to as the developing blade) 22 for regulating the toner on the surface of the developing roller. The photosensitive drum 1 and the developing roller 21 are rotated in a forward direction in an opposed part as indicated by arrow in FIG. 12, and a predetermined gap is provided between the two.

A superimposed voltage comprising a DC voltage and an AC voltage is applied from a voltage source 8 to the developing roller 21, and the toner on the developing roller 21 given the charges is shifted to the photosensitive drum 1 in conformity with the aforementioned electrostatic latent image to thereby form a toner image and visualize the electrostatic latent image.

In synchronism with the forming of the toner image, paper (transfer material) P as a transferred member (recording medium) is transported from a cassette by transporting means comprising a pickup roller 10, and the toner image is transferred to the transfer material) P in a transferring nip part d by a transfer charging device (transfer roller) 5. The transfer material P is separated from the photosensitive drum 1, and subsequently is transported to a fixing apparatus 9, whereby the toner image is fixed as a permanent image.

Also, any toner T not transferred by the transfer charging device 5 but remaining on the photosensitive drum 1 is collected by the magnetic single-component developing apparatus 2 during the developing after the next process, i.e., in the case that the photosensitive drum 1 is continuedly charged, and is exposed to thereby form a latent image, and a toner image is formed in the magnetic single-component developing apparatus 2, and simultaneously therewith. This is called "cleaning simultaneous with developing".

The mechanism of cleaning simultaneous with developing will be described here. This cleaning method is a method of collecting any toner residual on the photosensitive drum after transferring during the developing after the next process, i.e., in case of continuedly charging the photosensitive member to thereby form a latent image, and developing the latent image, by a defogging bias (a defogging potential difference V back which is the potential difference between a DC voltage applied to developing means and the surface potential of the photosensitive drum) (see Japanese Patent Application Laid-Open No. 10-307456).

According to this method generally called a cleanerless system, the untransferred toner (residual toner) is collected by the developing means and is reused for the next and subsequent processes and therefore, waste toner can be eliminated and cumbersomeness in maintenance can be decreased.

Also, because of being cleanerless, the advantage in space is great and the image forming apparatus can be greatly downsized.

A description will now be made of the cleaning of the charging member 3 and the transfer member (transfer roller) 5 in the cleanerless type image forming apparatus using the contact charging member (charging roller) 3.

Because of the contact charging member being used, the untransferred toner not transferred in the transferring part but left on the photosensitive drum 1 is once introduced into the charging member 3. Generally the toner is an insulative substance and therefore, if the toner is present on the charging member 3 in a great deal, it will cause defective charging. So, a discharging bias is applied to the charging member 3 to thereby return the untransferred toner having entered the charging member to the photosensitive drum 1. Thereafter, the untransferred toner having reached the developing means 2 is returned into the developing device by a collecting bias by the developing means 2.

Also, when a material having powder retaining capability like sponge is used as the transfer member 5, the toner present on the photosensitive drum 1 in the absence of the transferred member P is caught by the transfer member 5 and becomes the cause of the stains of the end portion of the paper which is the transferred member P. So, a discharging bias is applied to the transfer member 5 to thereby return the untransferred toner having entered it to the photosensitive drum 1. Thereafter, the toner discharged in the same manner as described above is returned into the developing device by the collecting bias by the developing means 2.

However, in the case of an image forming apparatus in which a discharging bias is applied to the charging member 3 and the transfer member 5 to thereby effect cleaning, the removal of the toner or powder particles adhering to the charging member 3 and the transfer member 5 has been incomplete in some cases. In such cases, when the image forming operation is repeated, image defects such as fog, an uneven image, light interception and the stain of the end portion of the paper occur. The causes of the occurrence of those image defects will be shown below.

1) Uneven Image

Generally the toner is an insulator and therefore, if the toner is present in the contact portion a between the charging member 3 and the photosensitive drum 1, the charging of the surface of the photosensitive drum will be interrupted. As a result, unevenness will occur to the toner image on the photosensitive drum and that portion will become an image defect called an uneven image. This uneven image is very liable to occur as the untransferred toner is accumulated on the charging member 3.

2) Fog

The toner introduced onto the charging member 3 causes the deterioration of the toner such as the extraneous additive of the toner being embedded or stripped off by the charging member being rotated, and along therewith, the charging capability of the toner is lowered. If such toner drops onto the photosensitive drum 1, even if a collecting bias is applied to the developing device, the toner will not be returned to the developing device, but will be intactly transferred onto the transferred member (such as paper) P. When this toner is present in other area than a latent image area, it becomes an image defect called fog. This fog toner is introduced into the transfer member 5 when paper or the like which is the transferred member P is absent in the transferring nip part d. As the fog toner increases, the toner in the transfer member 5 also increases in proportion to it, and the stain of the end portion of the paper becomes liable to occur.

3) Light Shielding (Light Interception)

This intercepts exposure when the toner or electroconductive powder is present in a great deal on the surface of the photosensitive roller after the charging of the charging roller. Therefore, this causes the image defect that a toner image is not formed at the intercepted position. When the toner introduced into the charging member is great in quantity, as described above, it causes an image defect.

The reason why cleaning becomes incomplete by the conventional cleaning method will now be described with reference to FIG. 13 of the accompanying drawings. FIG. 13 is a potential model view during the cleaning in the above-described image forming apparatus using a negative charging polarity toner.

In FIG. 13, Vn is the potential of a charging bias being applied to the charging roller, Vt is the potential of a transferring bias being applied to the transfer roller, and Vdt is the potential of the photosensitive drum between transferring and charging when the charging bias and the transferring bias are being applied. The dark potential Vd of the photosensitive drum during image forming is set to −600V.

Vn=−620 to −720V(AC voltage)

Vd=−600V

Vt=−1000V

Vdt=−700V

As shown, at the transferring position d, the toner on the transfer member 5 is discharged onto the photosensitive drum by −1000V being applied to the transfer member. At that time, the surface potential Vdt of the photosensitive drum becomes −700V. Thereafter, the potential Vdt intactly reaches the charging nip part a which is the contact portion between the charging member 3 and the photosensitive drum 1. If at the charging position a, the surface potential of the photosensitive drum is normal −600V which is the dark potential during image forming, the toner in the charging member 3 is moved to the photosensitive drum 1 by the voltage Vn being applied, but the surface potential of the photosensitive drum is Vdt and therefore, there is a case where the toner in the charging member 3 remains uncharged and conversely the toner discharged from the transfer member 5 is introduced into the charging member 3.

This phenomenon particularly affects the time of jam of a high coverage image print, and fog is very liable to occur after the jam. It is because a great deal of toner is present on the photosensitive drum 1 during jam and almost all of it is introduced into the charging member 3 and the transfer member 5.

SUMMARY OF THE INVENTION

It is an object of the present invention to provide an image forming apparatus in which the cleaning of a charging member can be effected well.

It is another object of the present invention to provide an image forming apparatus including a movable image bearing member, a charging member opposed to the image bearing member in a charging portion, a transfer member for transferring an image formed on the image bearing member by a developer to a transferred member, and a cleaning mode for applying a voltage to the transfer member, and when other area on the image bearing member differing from a surface potential changing area on the image bearing member which is changed in surface potential by the application of this voltage is located in the charging portion, applying a voltage to the charging member, thereby cleaning the transfer member and the charging member.

Further objects of the present invention will become apparent from the following description.

DETAILED DESCRIPTION OF THE PREFERRED EMBODIMENTS

Some embodiments of the present invention will hereinafter be described with reference to the drawings.

Embodiment 1

Figure 1:
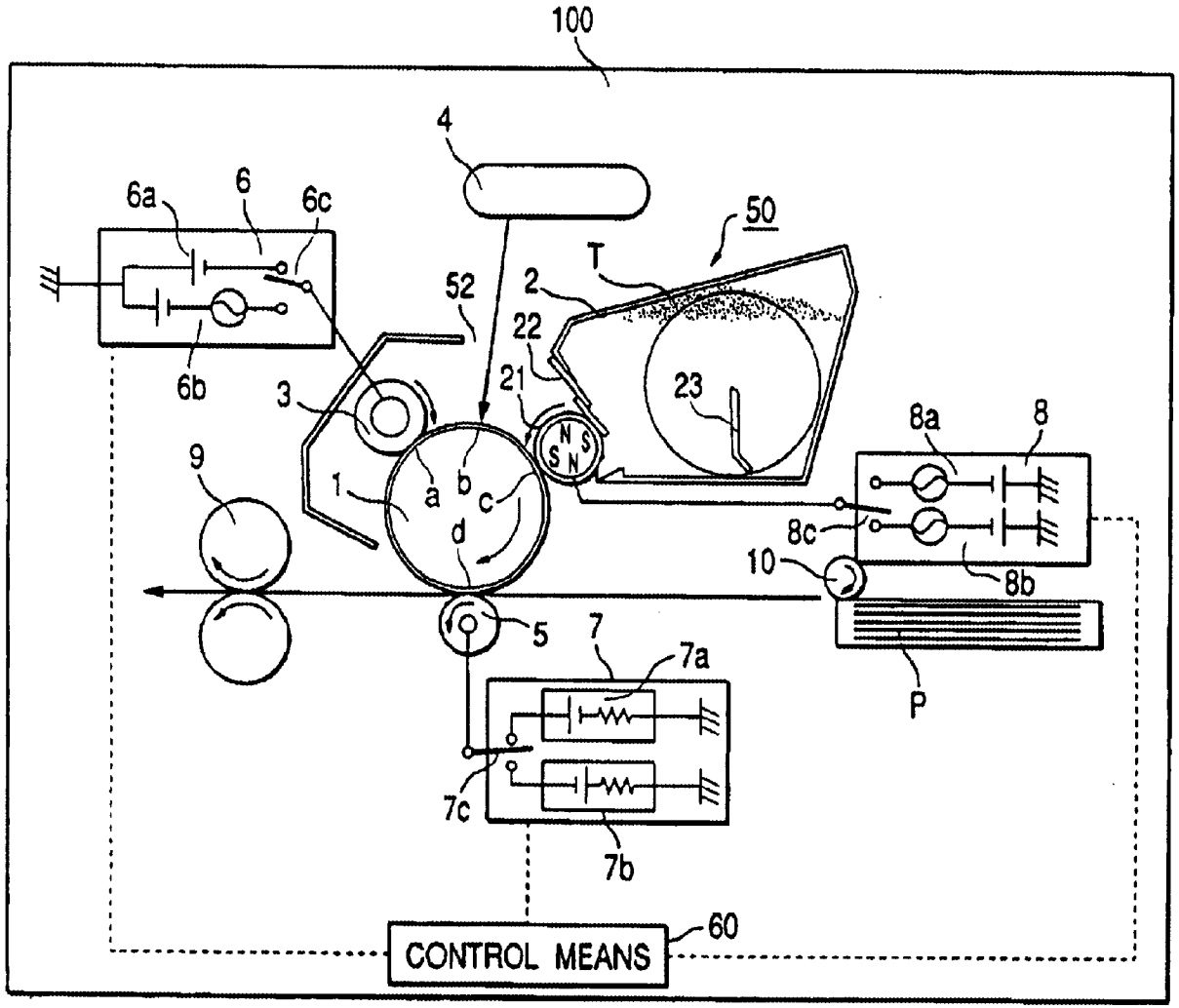
FIG. 1 is an illustration of the construction of an image forming apparatus according to Embodiment 1 of the present invention.
Figure 12:
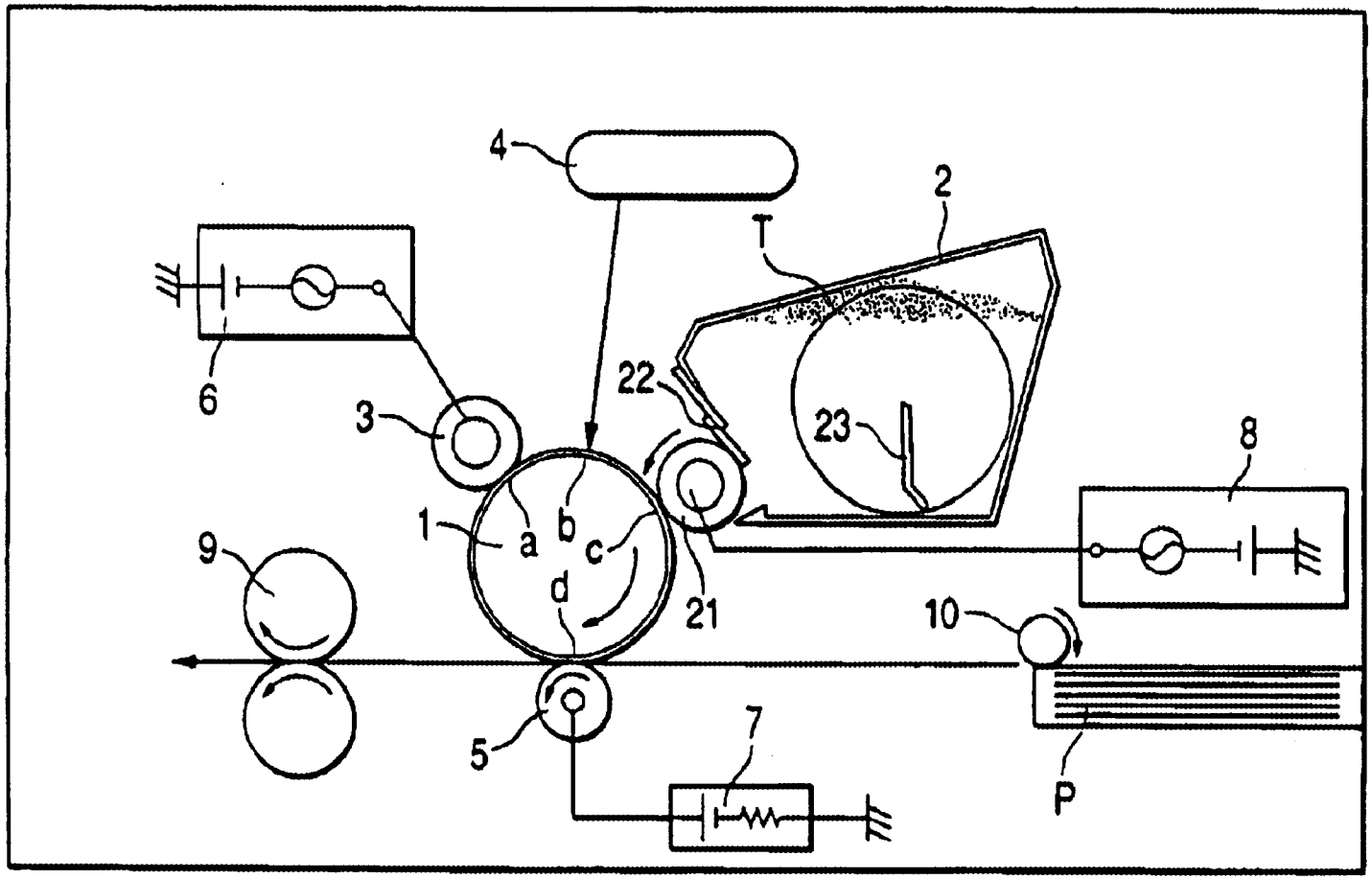
FIG. 12 PRIOR ART
FIG. 12 schematically shows the construction of a conventional electrophotographic apparatus.
Figure 13:
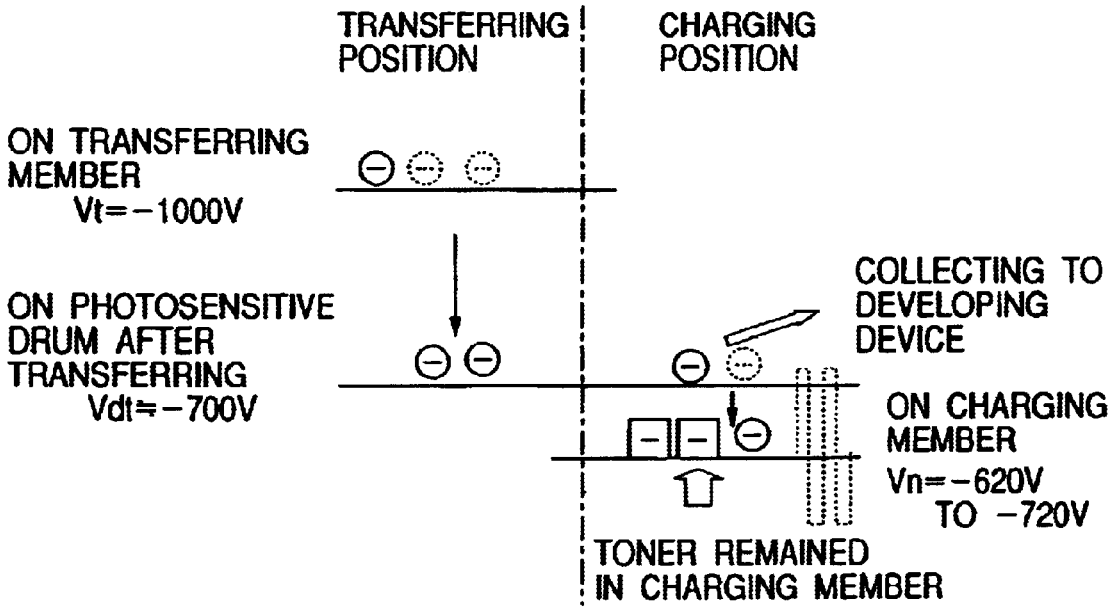
FIG. 13 PRIOR ART
FIG. 13 is a model view showing the behavior of a toner at a transferring position and a charging position during cleaning according to a conventional construction.

An image forming apparatus according to Embodiment 1 is shown in FIG. 1. This image forming apparatus, like the aforedescribed image forming apparatus of FIG. 12, is a cleaning simultaneous with developing type (cleanerless) electrophotographic printer in which charging means is a contact charging device using a charging roller 3 as a contact charging member and developing means is a magnetic single-component developing apparatus. The same constituents and portions as those of the image forming apparatus of FIG. 12 are given the same reference characters and need not be described again.

In the image forming apparatus according to the present embodiment, the charging roller 3 as a movable charging member is formed by forming on a mandrel a medium-resistance layer of rubber or a foamed material which is a flexible member having resistance of the order of $10^4$–$10^7\Omega\cdot$cm. The medium-resistance layer is prescribed by resin, a sulfurizing agent, a foaming agent or the like, and is formed into a roller shape.

A photosensitive drum 1 as a movable image bearing member is an organic photosensitive drum comprising an electrically conductive (aluminum) drum base and an undercoating layer, a charge producing layer and a charge transporting layer applied onto the drum base in the named order.

A developing roller 21 as a developer bearing member is a developing roller of a nonmagnetic material containing therein a stationary magnet roll having a plurality of N and S poles. The developing roller 21 has a coat agent provided on an aluminum elementary tube and is provided with moderate roughness. The developing roller is in non-contact with the photosensitive drum.

A developing blade 22 as a toner regulating member is a developing blade which is a plate-shaped member comprising urethane which is an elastic member and a metal plate stuck together.

A transfer member 5 is an electrically conductive and elastic transfer roller.

Also, in the image forming apparatus according to the present embodiment, use is made of a process cartridge 50 collectively containing therein three process apparatuses, i.e., the photosensitive drum 1, the charging roller 3 and a developing apparatus 2, and detachably mountable with respect to an image forming apparatus main body.

A voltage source 6 for applying a charging bias to the charging roller 3 is provided with a first voltage source 6*a* and a second voltage source 6*b*, and the switching of the two voltage sources is done by a switch 6*c*. By the switch 6*c* being switched to the first voltage source 6*a* side, a predetermined DC voltage is applied to the charging roller 3. By the switch 6*c* being switched to the second voltage source 6*b* side, a predetermined superimposed bias differing from the voltage by the first voltage source 6*a* and comprising a DC voltage and an AC voltage superimposed upon each other is applied to the charging roller 3.

Also, a voltage source 8 for applying a developing bias to the developing roller 21 is provided with a first voltage source 8*a* and a second voltage source 8*b*, and the switching of the two voltage sources is done by a switch 8*c*. By the switch 8*c* being switched to the first voltage source 8*a* side, a predetermined superimposed bias comprising a DC voltage and an AC voltage superimposed upon each other is applied to the developing roller 21. By the switch 8*c* being switched to the second voltage source 8*b* side, a predetermined superimposed bias differing from that by the first voltage source 8*a* and comprising a DC voltage and an AC voltage superimposed upon each other is applied to the developing roller 21.

Also, a voltage source 7 for applying a transferring bias to the transfer roller 5 is provided with a first voltage source 7*a* and a second voltage source 7*b*, and the switching of the two voltage sources is done by a switch 7*c*. By the switch 7*c* being switched to the first voltage source 7*a* side, predetermined plus potential of DC voltage opposite in polarity to the charging polarity of a toner is applied as a transferring bias to the transfer roller 5. By the switch 7*c* being switched to the second voltage source 7*b* side, predetermined minus potential of DC voltage of the same polarity as the charging polarity of the toner is applied as a toner discharging bias to the transfer roller 5.

The switching control of the voltage source switching switch 6*c* of the voltage source 6 for applying the charging bias, the voltage source switching switch 8*c* of the voltage source 8 for applying the developing bias, and the voltage source switching switch 7*c* of the voltage source 7 for applying the transferring bias is done in accordance with and in association with a predetermined sequence program by a control circuit 60 which is control means.

The photosensitive drum 1 is rotatively driven at a predetermined peripheral speed in the direction of arrow. The charging roller 3 is brought into contact with the photosensitive drum 1 with a predetermined pressure force, and is disposed so as to form a charging nip part a of a predetermined width. That is, the charging roller 3 is opposed to the photosensitive drum 1 in a charging part (charging nip part). The charging roller 3 is movable, and the moving speed of the charging roller 3 and the moving speed of the photosensitive drum 1 in the charging nip part (the contact portion between the charging roller 3 and the photosensitive drum 1) differ from each other. Specifically, in this charging nip part a, the charging roller 3 is rotatively driven at a speed of 150% in terms of peripheral speed difference in a counter direction relative to the direction of rotation of the photosensitive drum 1.

During an image forming mode, the voltage source switching switch 6*c* of the voltage source 6 for applying the charging bias is switching-controlled to the first voltage source 6*a* side and a DC charging bias of −600V is applied to the charging roller 3, and the surface of the photosensitive drum is uniformly charged to predetermined charging potential.

This charged photosensitive drum 1 is exposed to a laser beam from optical means 4 through an exposure opening portion 52 provided in a cartridge frame 51 to thereby form an electrostatic latent image on the photosensitive drum 1, and the electrostatic latent image is visualized as a developed image (toner image) by the developing apparatus 2 which is developing means.

This developing apparatus 2 is a reversal developing apparatus of a jumping developing type using a single-component magnetic negative toner as a developer. A toner T in a toner container is fed out by a toner agitating member 23 and the developing roller 21 is rotated and also, a toner layer given triboelectrification charges by the developing blade 22 for regulating the toner on the surface of the developing roller is formed on the surface of the developing roller 21, and the toner is shifted to the photosensitive drum 1 in conformity with the electrostatic latent image to thereby form a toner image and visualize it.

Then, a voltage opposite in polarity to the toner image is applied from the voltage source 7 for applying the transferring bias to the transfer roller 5 to thereby transfer the toner image to paper P which is a transferred member.

Any toner not transferred but residual on the photosensitive drum 1 is collected into the developing apparatus by the developing apparatus 2. The gap between the developing roller 21 and the photosensitive drum 1 is 200 $\mu$m.

Figure 2:
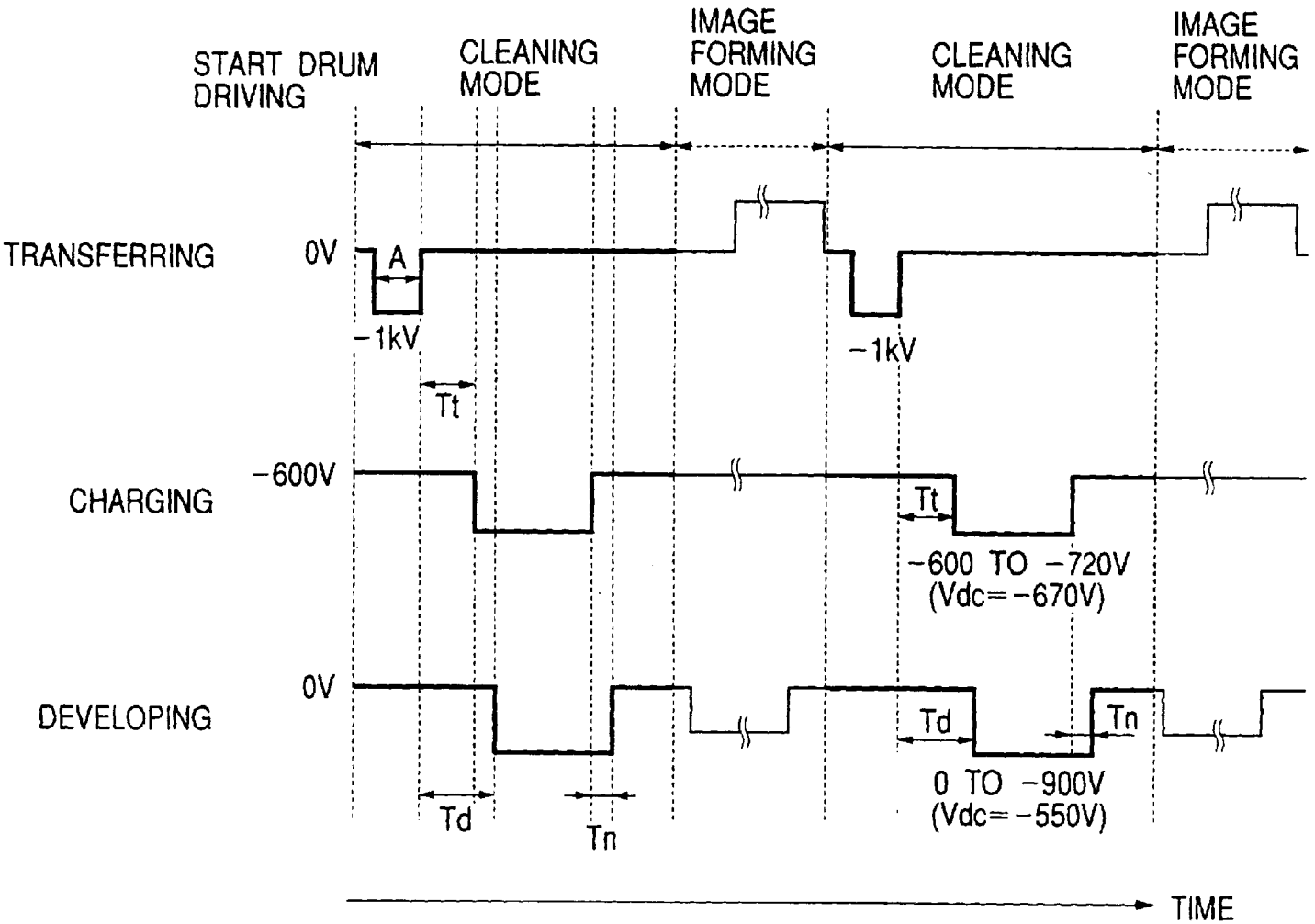
FIG. 2 shows a cleaning sequence according to Embodiment 1.
Figure 3:
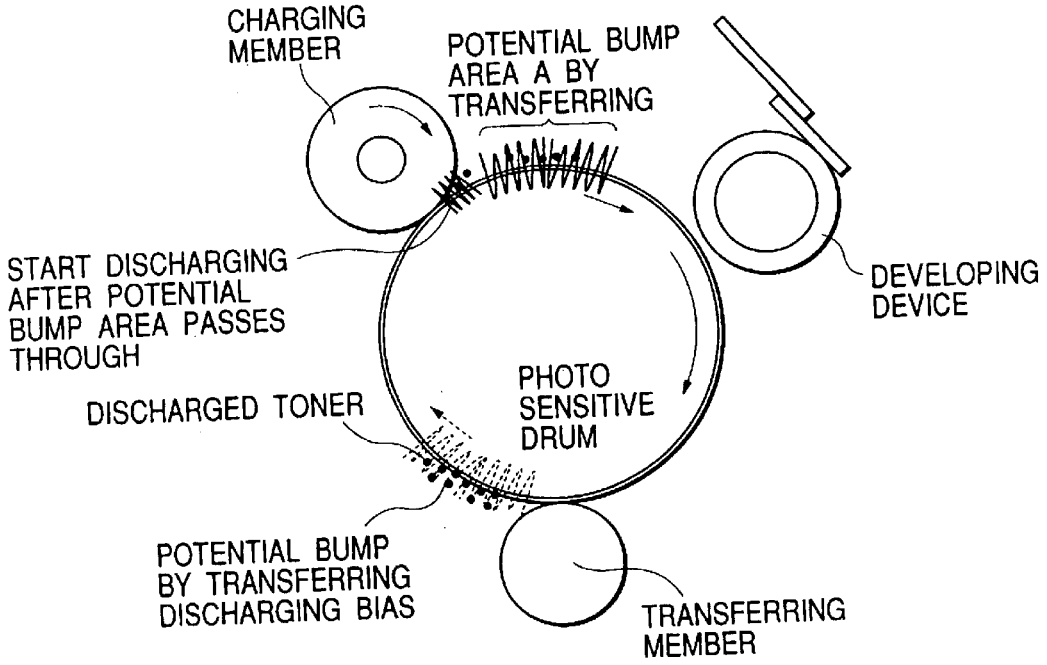
FIG. 3 is a model view of an operation during cleaning according to Embodiment 1.

The operation of the image forming apparatus according to the present embodiment will now be described with reference to FIGS. 2 and 3. FIG. 2 shows a sequence chart of the image forming apparatus according to the present embodiment, and FIG. 3 shows an operation model view during the cleaning of the present embodiment.

In order to effect the cleaning of the transfer roller 5 and the charging roller 3 after the termination of the image forming mode (this will hereinafter be called the cleaning mode), as shown in FIG. 2, after the start of the cleaning, the voltage source switching switch 7*c* of the voltage source 7 is first switched to the second voltage source 7*b* side, and a DC voltage of −1 kV is applied as a discharging bias to the transfer roller 5 to thereby shift the toner on the transfer roller to the photosensitive drum. Thereupon, from the influence of the application of −1 kV to the transfer roller 5, the surface potential of the photosensitive drum is changed (this will hereinafter be called the transfer potential level difference). This is "a potential level difference by a transferring discharging bias" indicated by dotted line in FIG. 3. After the area (change area) A of the potential level difference has passed through the charging part a in which the charging roller 3 exists (Tt after the termination of the transferring discharging bias in FIG. 2, and "the potential level difference area A by transfer" in FIG. 3), a voltage of −620 to −720V is applied as a charging discharging bias by switching the voltage source switching switch 6*c* of the voltage source 6 to the second voltage source 6*b* side, thereby shifting the toner on the charging roller to the photosensitive drum. That is, when other area differing from the surface potential changing area (potential level difference area) A on the photosensitive drum changed in surface potential by the application of this voltage is located in the charging part, a discharging bias is applied to the charging roller. The timing at which the discharging bias is applied to the charging roller is only when the aforementioned other area differing from the changing area A on the photosensitive drum is located in the charging part.

As regards a developing bias, a voltage of 0V to −900V is applied as a collecting bias from after the transferring potential level difference has reached a developing part c (Td after the termination of the transferring discharging bias in FIG. 2) until the area to which the charging bias has been applied terminates (Tn after the termination of a charging discharging bias in FIG. 2), whereby the toner on the photosensitive drum is collected.

In the present embodiment, the voltages applied to the charging roller and the developing roller during the cleaning mode are vibration voltages and as the vibration voltages, use is made of a voltage comprising an AC voltage and a DC voltage superimposed upon each other, but the vibration voltages may be a DC voltage controlled so as to have an AC component. At this time, preferably, the average value of the DC components of the vibration voltage applied to the charging roller may be −670V and the average value of the DC components of the vibration voltage applied to the developing roller may be −550V.

It is to be understood that the above-described cleaning process is carried out between sheets which is between an image forming time and the next image forming time, and is carried out immediately after the driving of the photosensitive drum has once been stopped and next the driving has been started, such as the activation of the image forming apparatus main body or the occurrence of jam.

Figure 4:
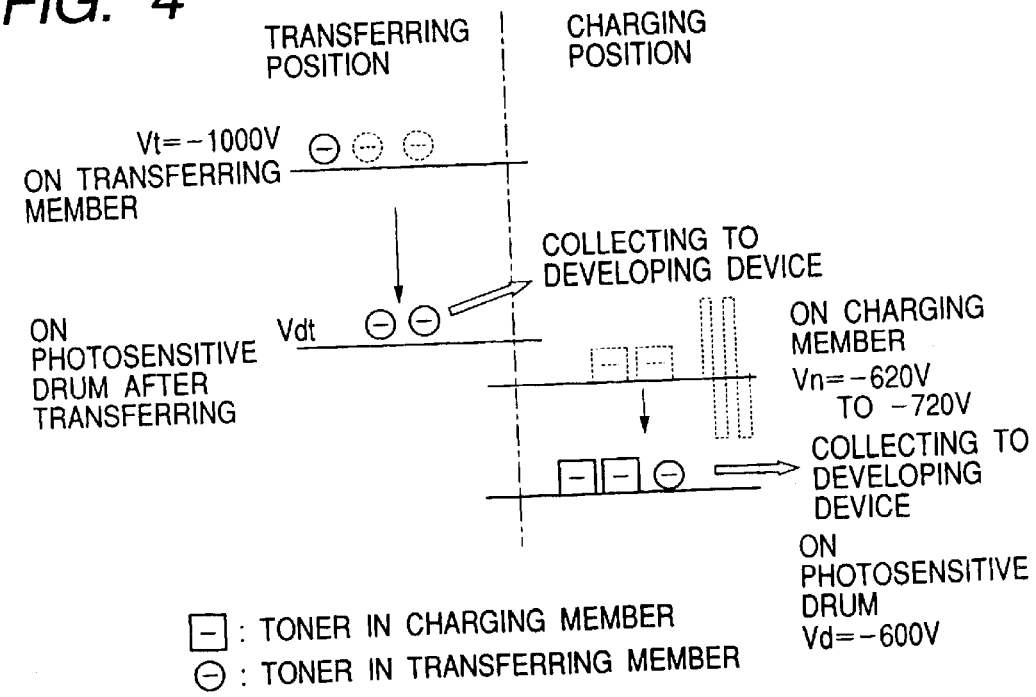
FIG. 4 is a model view showing the behavior of a toner at a transferring position and a charging position during the cleaning according to Embodiment 1.

The action of the present embodiment will now be described with reference to FIG. 4. FIG. 4 is a model view showing the behavior of the toner at a transferring position d and a charging position a during cleaning.

By the above-described cleaning process, as shown in FIG. 4, −1 kV is applied at the transferring position d and therefore, the toner adhering to the transfer roller 5 is returned onto the photosensitive drum 1. In some cases, the toner once comes into the charging roller 3 at the charging position a, but the timing at which a bias is applied to the charging roller 3 is after the potential level difference area A has passed through the charging part, and the potential of the photosensitive drum is −600V which is ordinary dark potential during image forming and therefore, by the voltage of the charging discharging bias −620 to −720V, the toner adhering to the charging roller 3 is also returned on the photosensitive drum 1 at the same time. Thereafter, the toner returned onto the photosensitive drum is returned into a developing device in a developing area c by a collecting bias.

The effect of the present embodiment will now be described for comparison with a conventional cleaning process.

The conventional cleaning process is such that the cleaning biases of the transfer roller 5 and the charging roller 3 are applied at a time on the photosensitive drum.

2,000 sheets of images of coverage 4% were fed to the above-described image forming apparatus as comparative experiment 1. The levels of image quality at this time were compared. The levels of image quality herein referred to are such that a case where fog, an uneven image and light interception cannot be visually confirmed at all is level 10, and a case where the average of the measured values of fog by reflected light (a measuring apparatus PEFLECTMETER TC-6D5) is 3% or greater and an uneven image and light interception are conspicuous is level 1, and levels 9 to 2 are determined in conformity with the occurrence frequency of fog, an uneven image and light interception.

Figure 5:
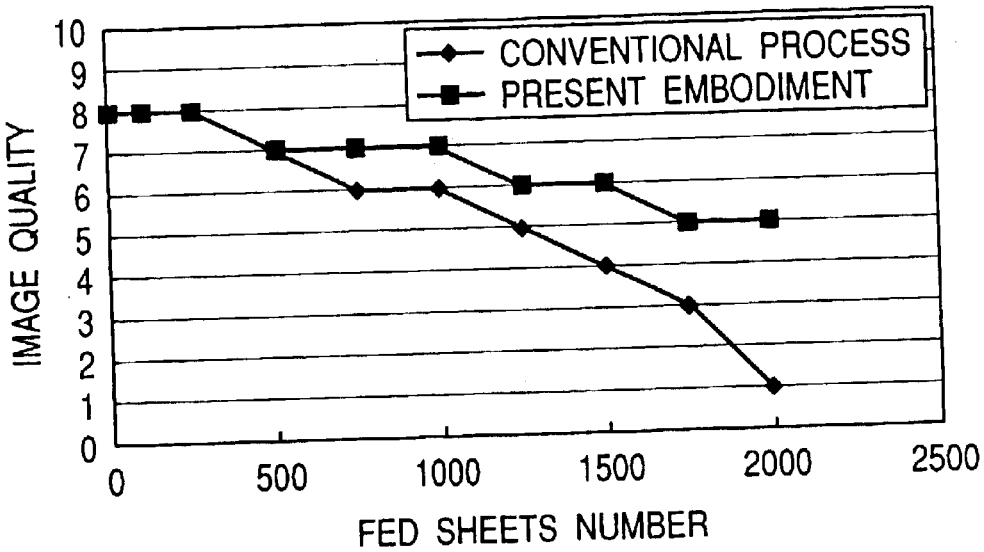
FIG. 5 shows the result of comparative experiment 1 according to Embodiment 1.

FIG. 5 shows the relation between the number of enduring sheets and the levels of image quality which is a result of comparative experiment 1. As shown in FIG. 5, it is conspicuous that in the conventional process, the level of image quality lowers after 1,200 sheets has been fed, and it is seen that for 2,000 sheets, the lowering of the level of image quality is apparently less in the process of the present embodiment.

Figure 6:
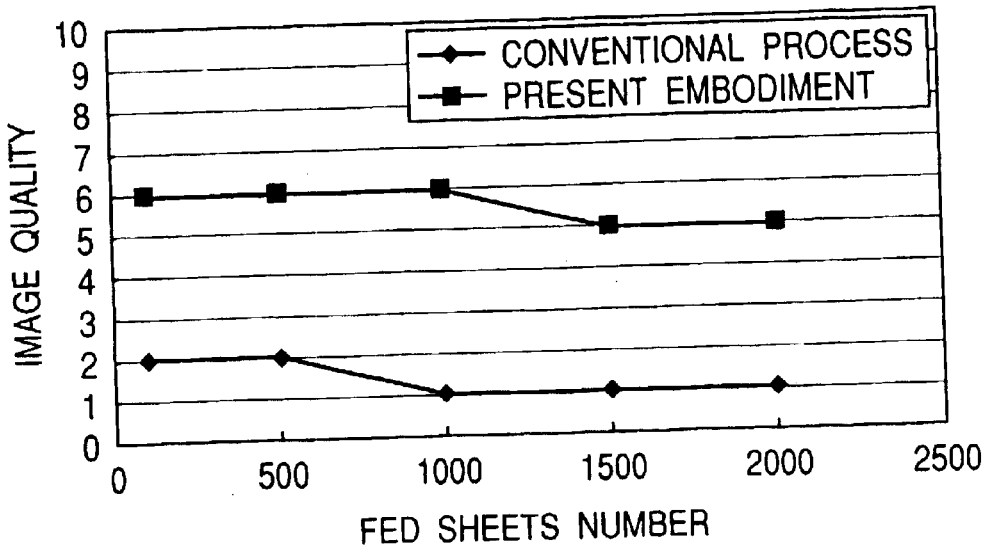
FIG. 6 shows the result of comparative experiment 2 according to Embodiment 1.

As comparative experiment 2, forcible jam is generated during the printing of whole surface black images on 100, 500, 1,000, 1,500 and 2,000 sheets during the above-described sheet feed endurance, whereafter whole surface while images are printed. The level of image quality in the white images at that time was evaluated. As shown in FIG. 6, in the conventional process, almost all were at level 1 of image quality, while in the process of the present embodiment, the level of image quality was 5 or higher.

As described above, the present embodiment could reduce image defects such as fog, uneven images and light interception even when the image forming operation was repetitively performed and when faulty sheet feed such as jam occurred.

Also, as in the present embodiment, the charging roller has a foamed material and therefore, an untransferred developer retaining force is generated in the charging roller and thus, the amount of discharged developer can be controlled. Thereby, a further reduction in image defects becomes possible.

In the present embodiment, use is made of the contact charging member, but if even an image forming apparatus having not only a contact charging system, but also a non-contact or like charging member is of a construction in which the transferring bias and the charging bias are changed during cleaning to thereby return particles such as the toner accumulated on the transfer member and the charging member to the photosensitive drum, the charging discharging bias is applied at other position than a transferring discharging position on the photosensitive drum, whereby it is possible to achieve an effect similar to that of the present embodiment.

Embodiment 2

Figure 7:
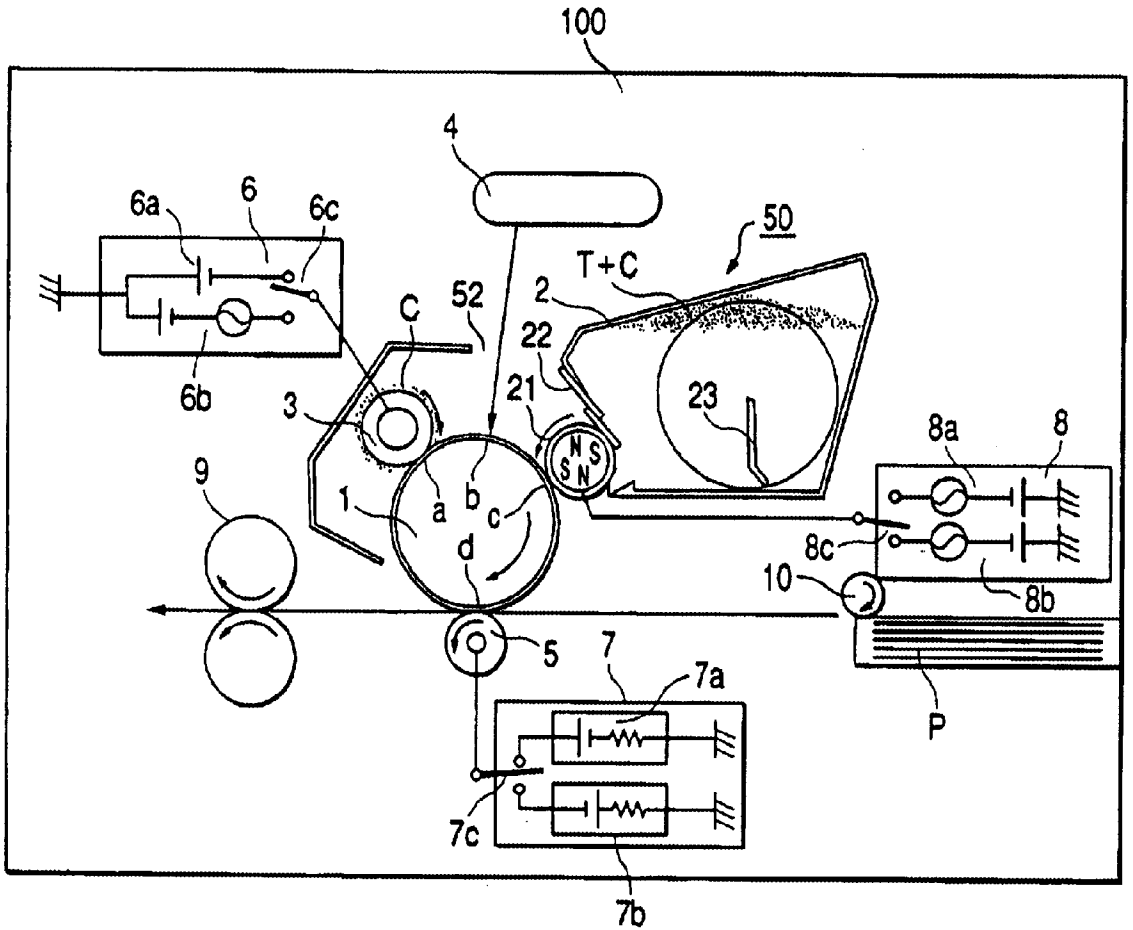
FIG. 7 is an illustration of the construction of an image forming apparatus according to Embodiment 2 of the present invention.

FIG. 7 schematically shows the construction of an image forming apparatus according to Embodiment 2. The image forming apparatus according to the present embodiment differs from the image forming apparatus (FIG. 1) according to Embodiment 1 in that as the developer of the developing apparatus 2, use is made of one comprising electroconductive powder C which is electroconductive particles mixed with a toner T at a predetermined rate, and in the other points, the construction of the image forming apparatus according to the present embodiment is the same as that of the image forming apparatus according to Embodiment 1. In the image forming apparatus according to the present embodiment, members functionally similar to those in Embodiment 1 are given the same reference characters and need not be described.

In Embodiment 2, the electroconductive powder C mixed with the toner T of the developing apparatus 2 adheres to the surface of the photosensitive drum 1 with the toner during the development of the electrostatic latent image on the surface of the photosensitive drum 1, and is brought to the charging nip part a through the transferring nip part d by the rotation of the photosensitive drum and is caught by the surface of the charging roller 3, whereby it is supplied to the peripheral surface of the charging roller 3. This electroconductive powder C intervenes in the nip part between the charging roller and the photosensitive drum and functions as a charging promoter, and makes a stable photosensitive drum charging mechanism possible in the cleanerless system even if the image forming operation is repetitively performed.

The construction and operation of the image forming apparatus according to the present embodiment are similar to those of the image forming apparatus according to Embodiment 1 and therefore need not be described. The photosensitive drum, the charging roller and the electroconductive powder used in Embodiment 2 will be described below.

The photosensitive drum 1 is improved in charging performance by further applying a charge injecting layer to an organic photosensitive drum comprising an aluminum drum base, and an undercoating layer, a charge producing layer and a charge transporting layer applied onto the aluminum drum base in the named order.

The charging roller 3 as a contact charging member is formed by the use of a mandrel and a foamed material having resistance of the order of $10^4$ to $10^7\Omega$ formed into a roller shape so as to be concentric and integral with the outer periphery of the mandrel. At an initial stage, 0.2 g electroconductive powder C which is electroconductive particles is applied to the charging roller, and the charging roller is rotated in a counter direction at a peripheral speed of 150% relative to the photosensitive drum 1.

Electroconductive zinc oxide is used as the material of the electroconductive powder C. Besides, however, electroconductive inorganic powder of other metal oxide is usable. The electroconductive powder C, in order to effect the exchange of charges through particles, need have particle resistance of $10^{12}\Omega\cdot$cm or less, and preferably $10^6\Omega\cdot$cm or less. The measurement of the resistance was effected by measuring and normalizing the resistance by the pellet method. That is, about 0.5 g of powder sample was put into a cylinder having a bottom area of 2.26 $cm^2$, and pressurization of 147 N (15 kgf) was effected on upper and lower electrodes and at the same time, potential of 100V was applied thereto and resistance was measured, whereafter it was normalized and specific resistance was calculated.

The electroconductive powder C should desirably have a weight average particle diameter of 0.1 $\mu$m to 5 $\mu$m in order to obtain good charging uniformity. As regards the measurement of the particle diameter, 100 or more particles were extracted from an observation through an optical or electronic microscope, and a volume particle size distribution was calculated from a maximum chord length in a horizontal direction, and the particle diameter was determined by the average particle diameter of 50% thereof.

As regards the measurement of the charging characteristic of the electroconductive powder C, 9 g of fluorine coat resin and 1 g of electroconductive powder are mixed together in a sample tube, and the sample tube is shaken about 30 times to thereby charge the electroconductive powder, and the charged amount thereof is measured. Then, similar measurement was effected on the toner and fluorine coat resin, and either positiveness or negativeness relative to the charged amount of the toner was determined. The electroconductive powder in the present embodiment exhibited a positive tendency which is an opposite polarity to the toner. Also, it is necessary to provide a difference in the influence of potential between the toner and the electroconductive powder and therefore, it is desirable that the electroconductive powder be opposite in polarity to the toner.

The electroconductive powder C in the present embodiment, when the vibration voltage 0 to 900V of a developing bias is applied thereto, flies, in a non-image area, from the developing roller 21 to the photosensitive drum 1 with a contrast of 600V ($|Vmin-Vd|=(|0-(-600)|)$) Also, the electroconductive powder C adheres to the toner T and therefore, in an image area, it flies with a contrast of 730V ($|Vmax-V1|=(|-900-(-170)|)$). V1 is the potential of the light portion of the photosensitive drum.

The electroconductive powder C having flown to the photosensitive drum 1 is positive and therefore, after the transferring step, it is residual on the photosensitive drum 1 together with the untransferred toner. Thereafter, much of it can be supplied to the surface of the charging roller 3 rotated in a counter direction to the photosensitive drum 1. In this manner, even if the electroconductive powder C applied to the charging roller 3 at the initial stage is decreased by the image forming operation being rotated, fresh electroconductive powder is supplied from within the developing apparatus 2 and therefore the charging performance can be maintained.

The operation of the image forming apparatus according to Embodiment 2 will now be described. The sequence chart of the image forming apparatus according to Embodiment 2 is similar to that of Embodiment 1, and is shown in FIG. 2. As shown in FIG. 2, after the start of the cleaning mode, a DC voltage of −1KV is first applied as a discharging bias to the transfer roller 5. After a transferring potential level difference has passed the charging roller 3 (Tt in FIG. 2), an AC voltage of −620 to −720V is applied as a discharging bias to the charging roller 3. As regards a developing bias, a vibration voltage of 0V to −900V (a DC component average value −550V) is applied as a collecting bias from after an area to which a transferring bias of −1 kV has been applied has reached the developing part c (Td in FIG. 2) until an area to which a charging bias has been applied terminates (Tn in FIG. 2).

It is to be understood that the above-described cleaning process is carried out between fed sheets which is between an image forming time and the next image forming time, and is also carried out immediately after the driving of the photosensitive drum is once stopped and the driving is started next, such as during the activation of the image forming apparatus main body or the occurrence of jam.

Figure 8:
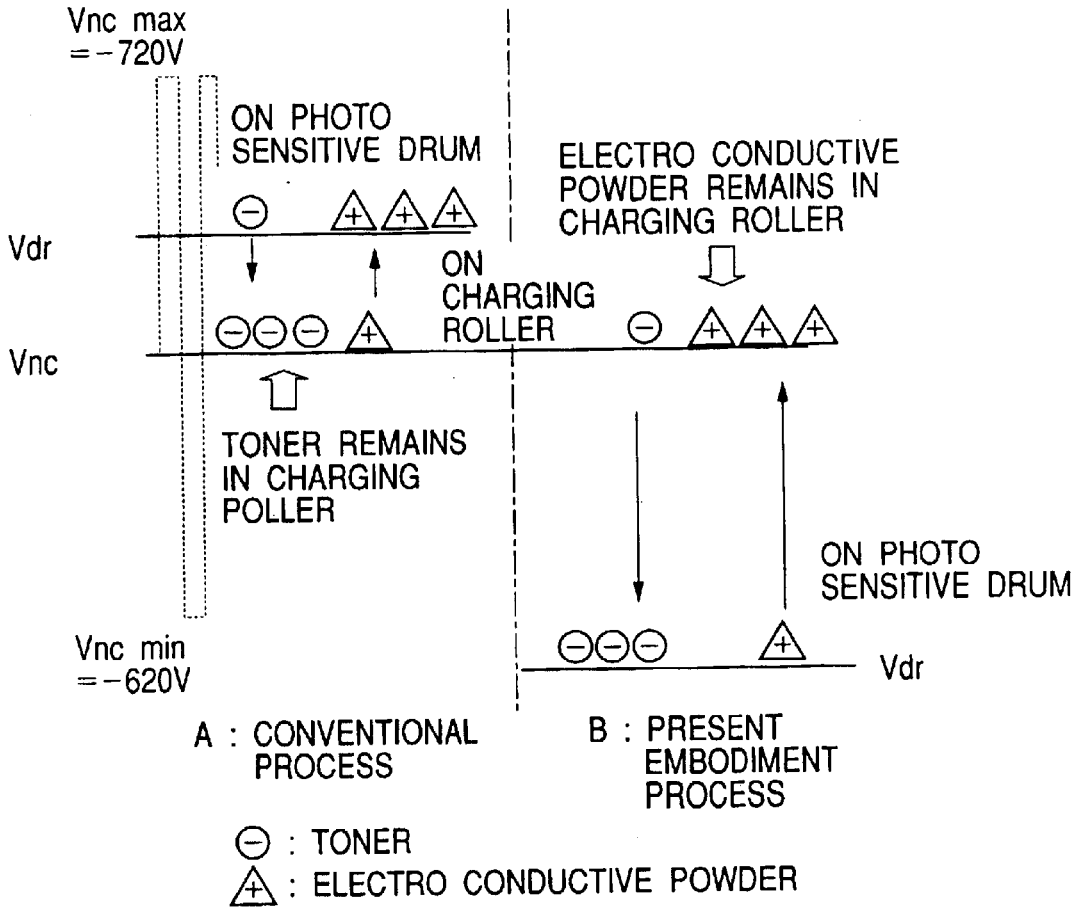
FIG. 8 is a model view showing the behavior of a toner at a charging position during cleaning according to Embodiment 2.

The action of the present embodiment will now be described with reference to FIG. 8. FIG. 8 is a model view when during the cleaning of the charging roller 3 and the transfer roller 5, the surface of the photosensitive drum given the potential level difference of a transferring cleaning bias has reached a charging position, and A is the conventional process of applying a transferring bias and a charging bias on the photosensitive drum at a time, and B is the present embodiment process of applying a charging bias after a portion on the photosensitive drum to which the transferring bias has been applied has passed.

When as in A, a charging discharging bias is applied at a position whereat a transferring discharging bias has been applied, the negative toner tends to fly to the charging roller 3 and the positive electroconductive powder tends to fly to the photosensitive drum 1 respectively, because the potential Vdr of the photosensitive drum 1 exists in the variation range of the charging discharging bias Vnc. However, as in B, at the present embodiment process, the potential Vdr of the photosensitive drum 1 exists under (plus side) the discharging bias Vnc and therefore, the toner stays on the photosensitive drum 1 and the electroconductive powder is liable to fly to the charging roller 3. Thus, in the present embodiment process, the charging roller 3 always becomes filled with the electroconductive powder C and the toner is returned to the photosensitive drum 1 and thereafter is collected into the developing device and therefore, the charging performance can be maintained in a good state.

The effect of the present embodiment will now be described for comparison with the conventional cleaning process.

The image forming apparatus used in comparative experiments is one introduced in the present Embodiment 2, and the difference between the conventional cleaning process and the present embodiment process is that the conventional process is one in which a cleaning bias to the transfer member is applied at the same time on the photosensitive drum and the present embodiment process is one in which they are discretely effected on the photosensitive drum.

As comparative experiment 1, 2,000 sheets of images of coverage 4% were fed by the use of the above-described image forming apparatus. The levels of image quality at this time were compared. The levels of image quality herein referred to are such that a case where fog and light interception cannot be visually confirmed at all is level 10, and a case where the average of the measured values of fog by reflected light (a measuring apparatus PEFLECTMETER TC-6DS) is 3% or greater and light interception is conspicuous is level 1, and levels 9 to 2 are determined in conformity with the occurrence frequency of fog and light interception.

Also, the uneven image evaluated in Embodiment 1 hardly occurred because the image forming apparatus used this time is one having the electroconductive powder.

Figure 9:
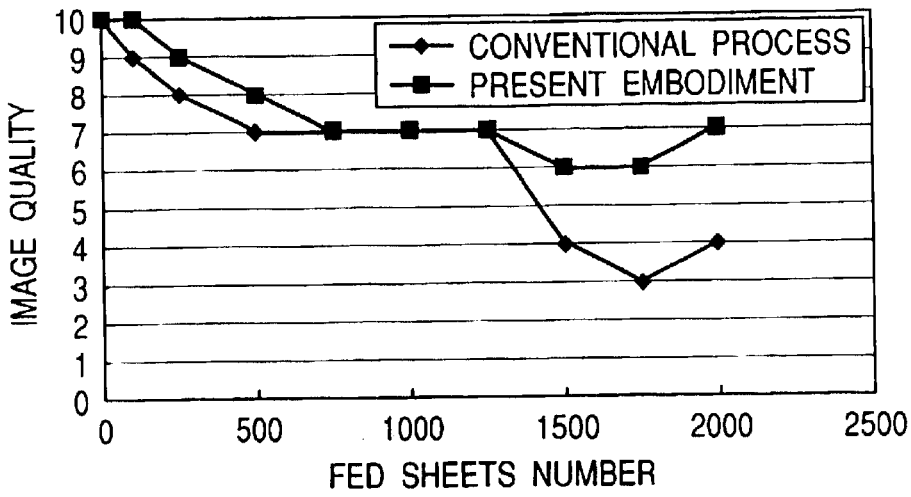
FIG. 9 shows the result of comparative experiment 1 according to Embodiment 2.

FIG. 9 shows the relation between the number of enduring sheets and the level of image quality which is the result of comparative experiment 1. As shown in FIG. 9, it will be seen that at the initial stage and the latter half of the number of fed sheets, the present embodiment process maintains a higher image quality.

Figure 10:
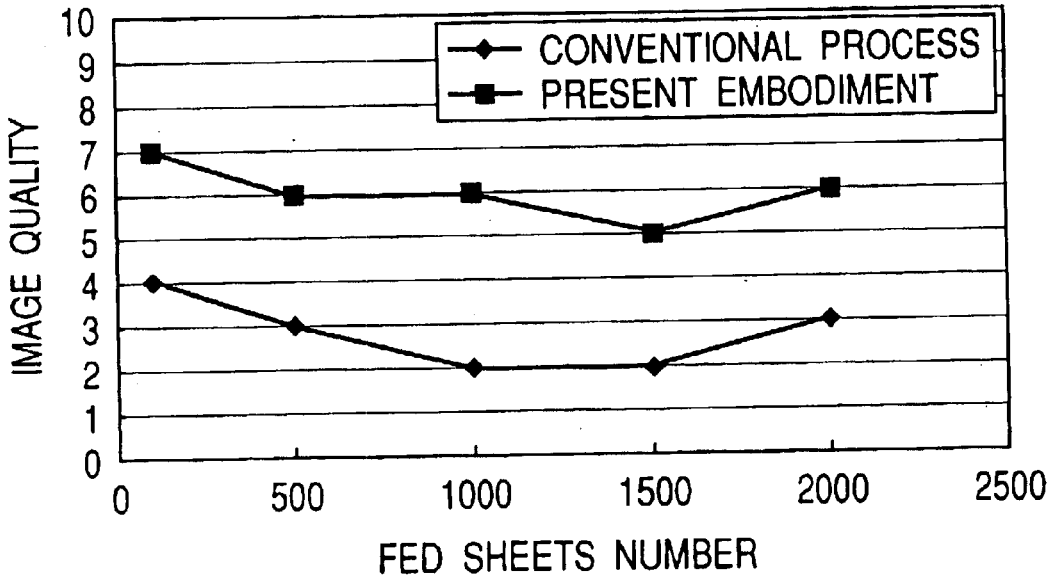
FIG. 10 shows the result of comparative experiment 2 according to Embodiment 2.

As comparative experiment 2, forcible jam is caused during the printing of generally black images on 100, 500, 1,000, 1,500 and 2,000 sheets during the above-described sheet feed endurance, whereafter generally white images are printed. The levels of image quality in the white images at that time were evaluated. FIG. 10 shows the result of comparative experiment 2. As shown in FIG. 10, it will be seen that at 100, 1,500 and 2,000 sheets, the present embodiment process maintains a higher image quality.

Also, when the state of the charging roller in the present experiment was observed, a great deal of toner was confirmed on the surface of the roller in the conventional process at the first half and the latter half of endurance. In contrast, the surface of the roller in the present embodiment process was almost filled with the electroconductive powder although more or less toner was present thereon. This shows that the amount of untransferred toner tends to increase at the first half and the latter half and in such a case, particularly the present embodiment exhibits an effect.

As described above, in the cleanerless type image forming apparatus having a contact charging mechanism utilizing the electroconductive powder, the present invention has made it possible to reduce image defects such as fog and light interception when the image forming operation is repetitively performed and when faulty sheet feeding such as jam occurs. Also, during cleaning, the electroconductive powder is supplied into the charging member and has the effect of returning the toner to the photosensitive drum and therefore, the charging performance can be maintained in a good state.

The contact charging member is used in the present embodiment, but if not only in an image forming apparatus of the contact charging type but also even an image forming apparatus having a non-contact or other type charging member, a design is made such that during cleaning, the transferring bias and the charging bias are changed to thereby return the particles of the toner or the like accumulated on the transfer member and the charging member to the photosensitive drum, the charging discharging bias is applied at other position than the potential level difference position of the photosensitive drum by transferring discharge, whereby it is possible to achieve an effect similar to that of the present embodiment.

Comparison with Other Embodiments

Next, other Embodiments A and B are set and image evaluation will be effected with the above-described Embodiments 1 and 2 and Comparative Examples 1 and 2.

Embodiments A and B have a cleaning process in which in an image forming apparatus shown below, as in the above-described Embodiments 1 and 2, a discharging bias is first applied to the transfer member 5 to thereby discharge the toner adhering to the transfer member 5, and next after the transferring discharging bias potential level difference on the photosensitive drum 1 has passed through the charging member 3, a discharging bias is applied to the charging member 3, and then the developing means 2 collects the toner discharged onto the photosensitive drum 1 at any time.

Embodiment 1: this is a cleanerless image forming apparatus of a jumping (non-contact) developing type using a toner as a developer.

Other Embodiment A: this is a cleanerless image forming apparatus of a contact developing type using a toner as a developer.

Other Embodiment B: this is a cleanerless image forming apparatus of the contact developing type using a toner and electroconductive powder as a developer, and utilizing a charging process in which the electroconductive powder is interposed in the contact portion between the contact charging member and the photosensitive drum.

Embodiment 2: this is a cleanerless image forming apparatus of the jumping developing type using a toner and electroconductive powder as a developer, and utilizing a charging process in which the electroconductive powder is interposed in the contact portion between the contact charging member and the photosensitive drum.

Figure 11:
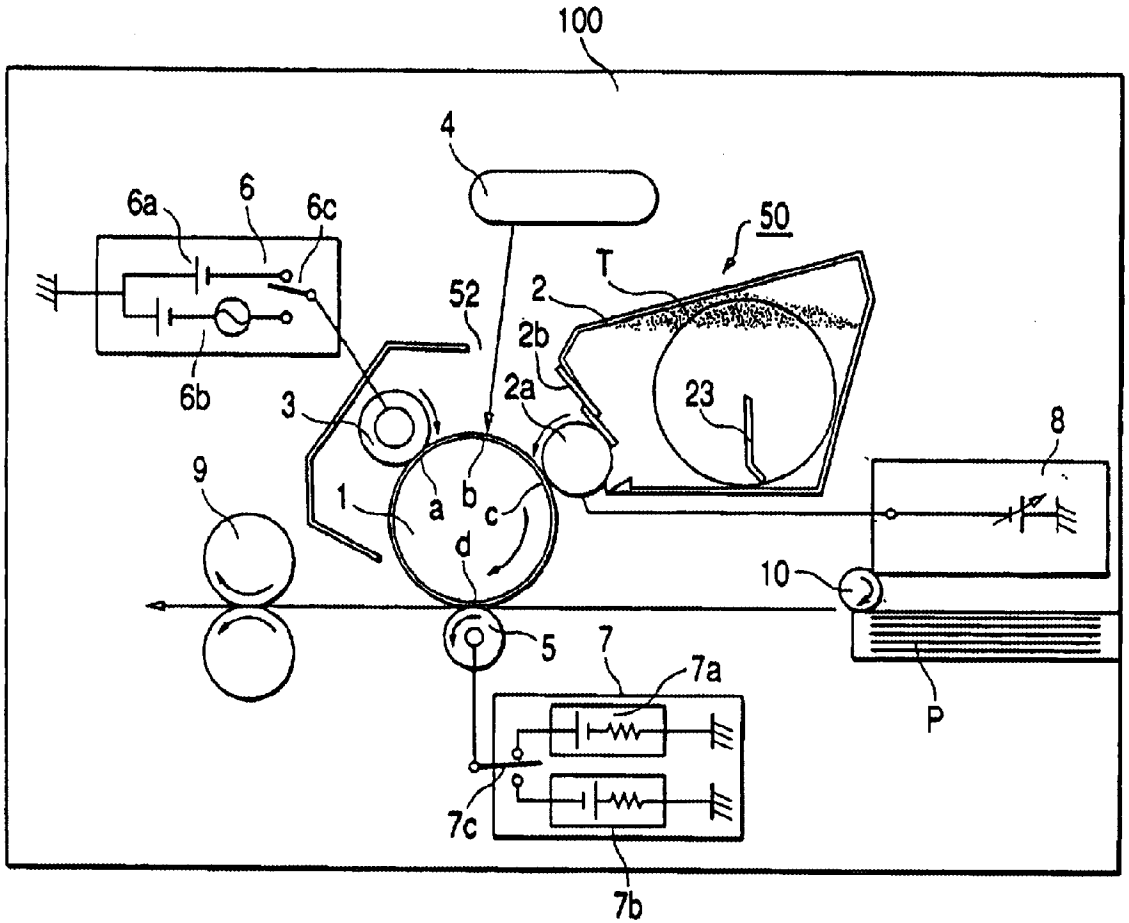
FIG. 11 is an illustration of the construction of an image forming apparatus according to Embodiment A of the present invention.

The contact developing process in other Embodiments A and B will be described here. FIG. 11 is an illustration of the construction of the image forming apparatus according to other Embodiment A. Members similar to those in Embodiments 1 and 2 are given the same reference characters and need not be described.

As a developing roller 2*a*, dip coat treatment was effected on the surface of an elastic rubber roller. The developing roller is rotated in a counter direction at a peripheral speed of 160% relative to the rotation of the photosensitive drum 1, as indicated by arrow in FIG. 11. Also, a DC voltage of 0V to −700V is applied as a developing bias to thereby effect contact developing with a predetermined nip width with respect to the photosensitive drum and contact-collect any untransferred toner.

Phosphor bronze is used as the material of a toner regulating member 2*b*, and the toner regulating member is mounted in a counter direction to the direction of rotation of the developing roller.

Embodiment B is such that in this construction, the developer comprises a toner and electroconductive powder.

[Items of Comparison]

1) Embodiment 1

2) Comparative Example 1: In the image forming apparatus according to Embodiment 1, a cleaning process of applying transferring and charging discharging biases on the photosensitive drum at a time (conventional process)

3) Embodiment A

4) Embodiment B

5) Comparative Example 2: In the image forming apparatus according to Embodiment B, a cleaning process of applying transferring and charging discharging biases on the photosensitive drum at a time (conventional process)

6) Embodiment 2

Experimental method: Under an environment of room temperature 32.5° C. and humidity 80%, 2,000 sheets of images of coverage 4% were fed, whereafter sample images were evaluated.

1: Evaluation of Fog on Paper

Fog is an image defect appearing on paper like a ground stain due to the toner being developed on an originally not printed portion (unexposed portion). As regards the amount of fog, the optical reflectance by a green filter was measured by the use of a measuring apparatus PEFLECT METER TC-6DS, and an amount of reflection subtracted from the reflectance of paper alone was found, and this was regarded as the amount of fog. In this case, ten or more points on the paper were measured, and the average value thereof was found.

◎ . . . less than 1%

○ . . . 1%–3%

Δ . . . 3%–5% x . . . greater than 5%

2: Evaluation of Light Interception

Light interception is an image defect that when the particles of the toner or the like exist in a great deal on the surface of the photosensitive drum after the charging of the charging roller, they intercept exposure and therefore a toner image is not formed at the intercepted position.

The amount of light interception was visually evaluated in a halftone image of lateral line 1 dot and 1 space.

◎ . . . cannot be confirmed

○ . . . can be more or less confirmed, but is almost inconspicuous

Δ . . . generally somewhat conspicuous x . . . considerably conspicuous

3. Uneven Image

Even if a discharging bias is being applied to the charging member, all the toner introduced thereinto cannot be discharged. Therefore, when the image forming operation is repetitively performed, untransferred toner is accumulated on the charging member. Generally the toner is an insulator and therefore, if it is present in the contact portion between the charging member and the photosensitive drum, the charging of the surface of the photosensitive drum is interrupted. As a result, unevenness occurs to the toner image on the photosensitive drum and that portion becomes an image defect called an uneven image. This uneven image is very liable to occur as the untransferred toner is accumulated on the charging member.

The amount of light interception was visually evaluated in a halftone image of lateral line 1 dot and 2 spaces.

◎ . . . cannot be confirmed

○ . . . can be more or less confirmed, but is almost inconspicuous

Δ . . . generally somewhat conspicuous x . . . considerably conspicuous

The results of the comparative experiments are shown in Table 1 below.

TABLE 1

Results of Comparative Experiments of Other Constructions

| | Image Evaluation | | |
|---|---|---|---|
| | fog on paper | light interception | uneven image |
| Embodiment 1 | ◎ | ◎ | ○ |
| Comparative Example 1 | Δ | x | x |
| Embodiment A | Δ | ○ | ○ |
| Embodiment B | ○ | ○ | ○ |
| Comparative | ○ | x | x |

TABLE 1-continued

Results of Comparative Experiments of Other Constructions

| | Image Evaluation | | |
|---|---|---|---|
| | fog on paper | light interception | uneven image |
| Example 2 Embodiment 2 | ◎ | ◎ | ◎ |

In Comparative Example 1, as described in Embodiment 1 and the prior art, the discharging effect of the charging member decreased in the portion of the photosensitive drum potential level difference due to the influence of the transferring discharging bias and fog, light interception and uneven image were all aggravated.

Also, in comparative Example 2, an image defect occurred due to a similar cause.

In Embodiment A, there is the effect of the present invention, and as compared with the comparative examples, an image defect does not occur so much. Because of the contact developing type, the ground fog from the developing apparatus is of such a degree as will pose no problem, but somewhat affects the image.

Embodiment B is better in ground fog than Embodiment A.

In contrast, Embodiment 1 is still better in ground fog and light interception than Embodiment A, and Embodiment 2 is best against charging defects and image defects, and it is seen that this embodiment is suited for the present invention.

<Others>

1) The charging member is not restricted to the roller shape and the contact type as in the embodiments, but even in an image forming apparatus having a charging member which is of a brush, blade or like shape and of a non-contact or like type, it is possible to achieve an effect similar to that of the embodiments.

2) The exposure means for electrostatic latent image forming is not restricted to the laser scanning exposure means 4 for forming a digital latent image as in the embodiments, but may be ordinary analog image exposure means or other light emitting element such as an LED, or any means which can form an electrostatic latent image corresponding to image information, such as a combination of a light emitting element such as a fluorescent lamp and a liquid crystal shutter or the like.

3) The image bearing member may be an electrostatic recording dielectric member or the like. In this case, the surface of the dielectric member is uniformly primary-charged to a predetermined polarity and potential, whereafter charges are selectively removed by charge removing means such as a charge removing needle head or an electron gun and a desired electrostatic latent image is written and formed.

4) The transferring means is not restricted to roller transfer, but can be belt transfer, corona transfer or the like. The image forming apparatus may be an image forming apparatus using an intermediate transfer member such as a transfer drum or a transfer belt to form not only a single-color image, but also a multicolor or full-color image by multiplex transfer or the like.

5) Direct injecting type charging has as its charging mechanism for charges to directly move from a contact charging member to a portion of a member to be charged and therefore, it is necessary for the contact charging member to sufficiently contact with the surface of the member to be charged, and it is desirable to rotate the contact charging member with a peripheral speed difference relative to the member to be charged. Specifically, the speed difference between the contact charging member and the member to be charged is provided by movingly driving the surface of the contact charging member to thereby provide a speed difference between it and the member to be charged. Preferably, design may be made such that the contact charging member is rotatively driven and the direction of rotation thereof is opposite to the direction of movement of the surface of the member to be charged. It is also possible to move the surface of the contact charging member in the same direction as the direction of movement of the surface of the member to be charged to thereby provide a speed difference, but the charging property of direct injecting type charging depends on the ratio between the peripheral speed of the member to be charged and the peripheral speed of the contact charging member and therefore, to obtain the same peripheral speed ratio as in a reverse direction, the number of revolutions of the contact charging member in a forward direction becomes great as compared with that in the reverse direction and therefore, it is more advantageous in the number of revolutions to move the contact charging member in the reverse direction. The peripheral speed ratio described herein is the peripheral speed ratio (%)=(the peripheral speed of the contact charging member−the peripheral speed of the member to be charged) the peripheral speed of the member to be charged×100 (the peripheral speed of the contact charging member is a positive value when in the contact portion, the surface of the contact charging member in moved in the same direction as the surface of the member to be charged).

6) As the waveform of the alternating voltage component (AC component, a voltage periodically varied in voltage value) of the bias applied to the charging member or the developer bearing member, use can suitably be made of a sine wave, a rectangular wave, a triangular wave or the like. Use may also be made of a rectangular wave formed by periodically switching on/off a DC voltage source.

As described above, according to the present invention, in an image forming apparatus adopting a cleanerless system for effecting collecting simultaneous with developing, and a cleanerless type image forming apparatus having a contact or proximate charging mechanism utilizing electroconductive powder, after the potential level difference position of an image bearing member generated when transfer cleaning is effected has passed the charging member, charging cleaning is effected, that is, charging cleaning is effected at a position of the image bearing member differing from the potential level difference position, whereby image defects such as fog, an uneven image and light interception are made reducible, and even when the image forming operation is repetitively performed and when faulty feed such as jam occurs, stable images of high quality can be provided. Particularly, in an image forming apparatus which has a contact charging mechanism having electroconductive powder interposed in a charging member and in which the electroconductive powder is supplied from developing means, it is effectively done to supply the electroconductive powder to the charging member and return any untransferred developer onto an image bearing member and therefore, the effect of the present invention is displayed sufficiently.

While the embodiments of the present invention have been described above, the present invention is not restricted to the above-described embodiments, but all modifications are possible within the technical idea of the present invention.

What is claimed is:

1. An image forming apparatus having:

a movable image bearing member;

a charging member opposed to said image bearing member in a charging portion;

a transfer member for transferring an image formed on said image bearing member to a transferred member; and control means for executing a cleaning mode for transferring toner from said transfer member and said charging member to said image bearing member, wherein, by applying a voltage to said transfer member so as to clean said transfer member in the cleaning mode, a surface potential changing area in which a surface potential on said image bearing member varies is formed, and wherein, a voltage is applied to said charging member to clean said charging member at a certain time at least after the surface potential changing area on said image bearing member passes through the charging portion in said cleaning mode.

2. An image forming apparatus according to claim 1, wherein voltages of the same polarity as a charging polarity of the toner are applied to said transfer member and said charging member, respectively, whereby the toner on said transfer member and the toner on said charging member are shifted to said image bearing member.

3. An image forming apparatus according to claim 2, further comprising developing means for developing a latent image on said image bearing member, wherein said developing means collects the toner on said image bearing member transferred from said transfer member and said charging member.

4. An image forming apparatus according to claim 3, wherein said developing means includes a developer bearing member for bearing the developer thereon, and said developer bearing member is in non-contact with said image bearing member.

5. An image forming apparatus according to claim 2, wherein the voltage is an oscillating voltage to be applied to said charging member so as to clean said charging member.

6. An image forming apparatus according to claim 1, wherein said control means further executes an image forming mode for applying a voltage to said charging member to thereby charge said image bearing member to form the toner image on said image bearing member, wherein the voltage applied to said charging member during the cleaning mode differs from the voltage applied to said charging member during the image forming mode.

7. An image forming apparatus according to claim 1, having electroconductive particles between said charging member and said image bearing member.

8. An image forming apparatus according to claim 7, wherein a charging polarity of the electroconductive particles is opposite to a charging polarity of the toner.

9. An image forming apparatus according to claim 1, further comprising developing means for developing a latent image on said image bearing member with a developer, wherein said developer includes electroconductive particles, and electroconductive particles of said developing means are transported between said charging member and said image bearing member.

10. An image forming apparatus according to claim 9, wherein a charging polarity of the electroconductive particles is opposite to a charging polarity of the toner.

11. An image forming apparatus according to claim 1, wherein said charging member is movable and contacts with said image bearing member at a contact portion, and wherein a moving speed of said charging member is different from a moving speed of said image bearing member at the contact portion.

12. An image forming apparatus according to claim 11, wherein said charging member includes a foamed material formed on a surface thereof.

13. An image forming apparatus according to claim 11, wherein, at the contact portion, a moving direction of said charging member is opposite to a moving direction of said image bearing member.

14. An image forming apparatus according to claim 1, wherein said transfer member contacts with said image bearing member.

15. An image forming apparatus according to claims 1, 2 through 9, 5 through 10, and 14, wherein said charging member contacts with said image bearing member.

16. An image forming apparatus according to claim 15, wherein said image bearing member includes a charge injection surface layer.

* * * * *

UNITED STATES PATENT AND TRADEMARK OFFICE

CERTIFICATE OF CORRECTION

PATENT NO. : 6,898,393 B2
DATED : May 24, 2005
INVENTOR(S) : Takeshi Kawamura

It is certified that error appears in the above-identified patent and that said Letters Patent is hereby corrected as shown below:

Column 1,
Line 34, “a” should read -- an --.

Column 6,
Line 62, “is” should read -- is a --.

Column 8,
Line 6, “is” (second occurrence) should read -- are --; and
Line 63, “while” should be deleted.

Column 11,
Line 22, “is” (second occurrence) should read -- are --.

Column 17,
Line 18, “wherein,” should read -- wherein --.

Column 18,
Line 38, “claims 1, 2” should read -- claims 1-11, --; and
Line 39, “through 9, 5 through 10,” should be deleted.

Signed and Sealed this

Eighth Day of November, 2005

JON W. DUDAS
*Director of the United States Patent and Trademark Office*